US006623077B1

(12) United States Patent
Piaulet et al.

(10) Patent No.: US 6,623,077 B1
(45) Date of Patent: Sep. 23, 2003

(54) ACTUATING AND LOCKING SYSTEM FOR POSITIONING MOVING PARTS OF A BED, CHAIR OR SEAT

(75) Inventors: Jean-François Piaulet, Deols (FR); Laurent Groussin, Le Poinconnet (FR); Pascal Moulin, St Valentin (FR); Hugues Legras, Issoudun (FR)

(73) Assignee: P.G.A. Electronic (FR)

( * ) Notice: Subject to any disclaimer, the term of this patent is extended or adjusted under 35 U.S.C. 154(b) by 0 days.

(21) Appl. No.: 09/646,354

(22) PCT Filed: Apr. 1, 1999

(86) PCT No.: PCT/FR99/00759

§ 371 (c)(1),
(2), (4) Date: Oct. 23, 2000

(87) PCT Pub. No.: WO99/51126

PCT Pub. Date: Oct. 14, 1999

(30) Foreign Application Priority Data

Apr. 2, 1998 (FR) ..... 98 04111

(51) Int. Cl.[7] ..... B60N 2/02

(52) U.S. Cl. ..... 297/330; 297/362.11; 297/374; 297/362

(58) Field of Search ..... 297/330, 362.11, 297/375, 374, 362

(56) References Cited

U.S. PATENT DOCUMENTS

| | | | | |
|---|---|---|---|---|
| 4,508,386 A | | 4/1985 | Hofmann | |
| 4,759,587 A | | 7/1988 | Bucka | |
| 4,962,963 A | * | 10/1990 | Robinson | 297/362 X |
| 5,002,172 A | | 3/1991 | Stringer | |
| 5,052,752 A | * | 10/1991 | Robinson | 297/362.14 X |
| 5,248,184 A | | 9/1993 | Morris | |
| 5,435,625 A | | 7/1995 | Weber | |
| 5,542,744 A | * | 8/1996 | Bathrick | 192/141 |
| 5,575,531 A | * | 11/1996 | Gauger et al. | 248/429 |
| 6,055,877 A | * | 5/2000 | Welterlin et al. | 248/429 |

FOREIGN PATENT DOCUMENTS

| | | |
|---|---|---|
| DE | 3136653 | 9/1981 |
| EP | 0589731 | 3/1994 |

* cited by examiner

*Primary Examiner*—Anthony D. Barfield
(74) *Attorney, Agent, or Firm*—Thelen Reid & Priest LLP; Robert E. Krebs

(57) ABSTRACT

An electrical actuator for a seat with an inclinable back in which irreversibility (or blocking of the mechanism) and efficiency are independent of each other, efficiency being obtained by the use of a reduction gear with straight gear wheels (8), and irreversibility being obtained by a current release blocking device (7) mounted in parallel on an electric motor (5) and energized by the same control device (9) as the motor.

5 Claims, 1 Drawing Sheet

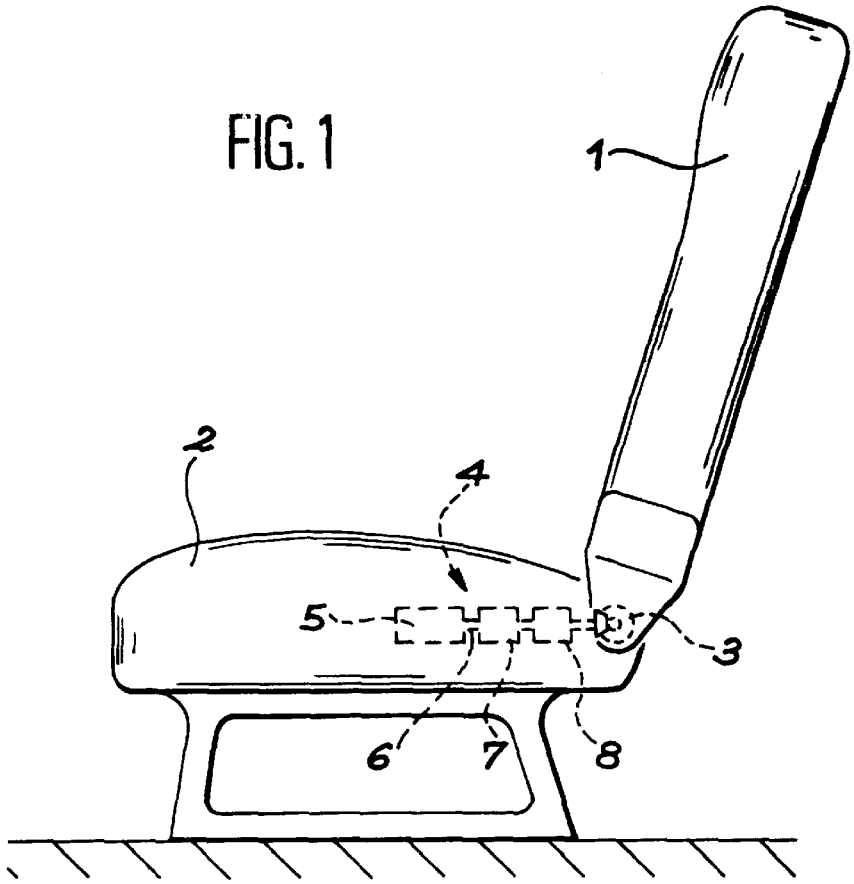
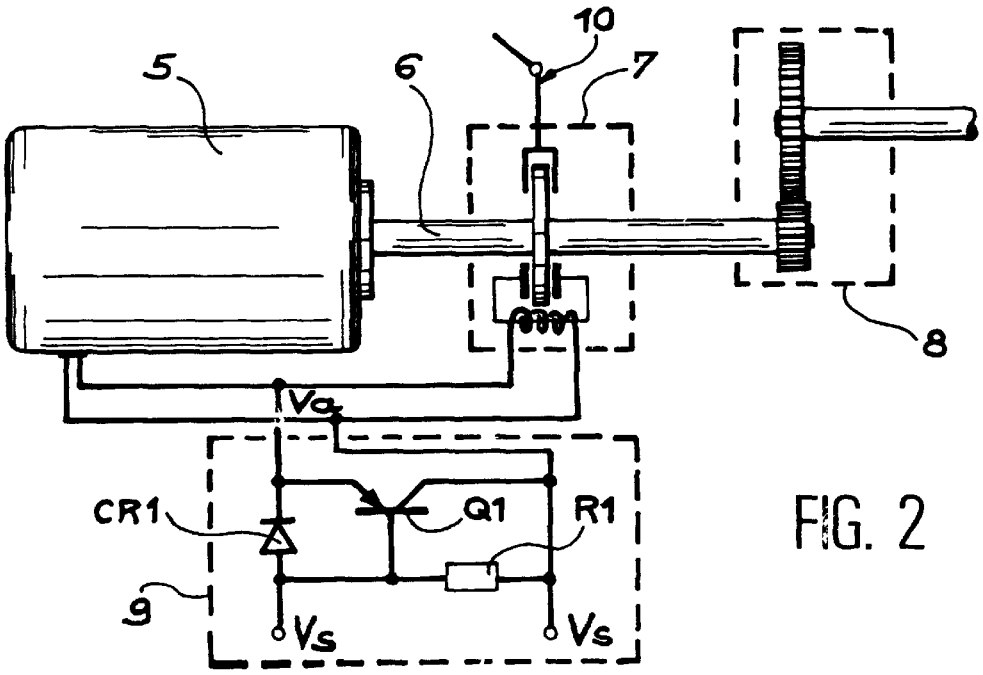
FIG. 2

ACTUATING AND LOCKING SYSTEM FOR POSITIONING MOVING PARTS OF A BED, CHAIR OR SEAT

DESCRIPTION OF THE INVENTION

The invention relates to an actuating system for modifying the position of the moving parts of a chair, seat or bed.

Applications of the invention may be found in all domains using a chair, seat or bed in which the moving parts may be activated electrically, as a function of the user's needs or comfort. In particular, the invention is applicable to seats designed for the transport of passengers such as aircraft seats, wheelchairs, dentists' chairs, medical seats or beds, electric stretchers, etc.

STATE OF PRIOR ART

In many domains, chairs and seats with inclinable backs or inclinable beds are used either for user comfort, such as aircraft seats, or for practical reasons such as dentists' chairs or wheelchairs.

Typically, the backs of chairs or seats (or beds) are inclined by means of an actuator made using a system of wheels and worm screws driven by a motor. This type of actuator is described particularly in patent U.S. Pat. No. 4 759 587.

However, in the case of these worm screw actuators, it is relatively difficult to block the mechanism (subsequently called irreversibility); thus, to achieve good irreversibility, the efficiency of the system is necessarily reduced. Therefore, use of this type of system requires a compromise between irreversibility and the actuator efficiency.

Furthermore, the coefficients of friction that determine the efficiency and irreversibility of this type of actuator fluctuate as a function of several parameters concerning the materials making up the actuator; in particular, they fluctuate as a function of the temperature and nature of lubrication of these materials.

Thus, when a worm screw actuator is used for a seat with a high static load, in other words a load greater than or equal to the dynamic capacity of the actuator itself, it is difficult to ensure good irreversibility; however a reduction in the efficiency must be accepted in order to obtain satisfactory irreversibility; therefore this actuator has a bad efficiency.

Furthermore, note also that as the efficiency drops, the value of the current necessary when the actuator is unloaded is high and variable due to friction; therefore sensitivity at a precise load is very low. Consequently, for seat movements for which the generated torque must be controlled, in other words in which the maximum force must be limited for safety reasons, it is very difficult if not impossible to adjust the safety threshold that must not be exceeded, given that this threshold must be sufficiently high so that the chair can be operated at nominal load, regardless of the situation.

Furthermore, poor efficiency of the actuator requires a large energy source, which causes an increase in the weight, volume and temperature rise of the system, and consequently high cost.

DESCRIPTION OF THE INVENTION

The purpose of the invention is precisely to overcome the disadvantages of the actuators mentioned above. Consequently, it proposes an electric actuator for which irreversibility (blocking of the mechanism) is independent of the efficiency and is obtained by a current release locking device installed in parallel on a motor and powered by the same control device as the motor.

More precisely, the invention relates to a system for modifying the position of the moving parts of a bed, chair or seat comprising:

- mechanical means for the displacement of a first part free to move with respect to a second fixed or moving part of the bed, chair or seat,
- actuation means fixed on the chair, seat or bed to activate or lock the said displacement means of the first part, characterized in that the actuation and locking means comprise:
- an electric motor powered by a control device,
- a rod driven by the motor,
- a current release blocking device, that prevents movement of the rod, mounted in parallel with the electric motor and connected to the control device,
- a transmission system driving the first part displacement means at a determined speed.

Advantageously, the current release blocking device is a brake which blocks the rod when there is no electricity power supply to it and which authorizes movement of the rod when it is powered.

According to this invention, the transmission system is a reduction gear with straight gear wheels.

According to one embodiment of the invention, the motor is a rotary motor driving the rod in a rotational movement.

BRIEF DESCRIPTION OF THE DRAWINGS

FIG. 1 diagrammatically shows a chair, in which the back is inclined by means of the actuating and locking system according to the invention; and FIG. 2 shows the functional block diagram of the actuating and locking system according to the invention.

DETAILED DESCRIPTION OF EMBODIMENTS OF THE INVENTION

FIG. 1 shows an example of a seat with an inclinable back equipped with the system for modifying and maintaining the back inclination in accordance with the invention.

For a better understanding of the invention, it will be described in its application to a seat with an inclinable back. However, note that the system according to the invention may also be used for a bed or a chair or a seat in which one or several moving parts (bed head, side rail, elevation system, back, head rest, leg rest, lower back rest, etc.) may change position.

The back position modification system shown on FIG. 1 comprises mechanical means 3 for the displacement of back 1 and actuating and locking means 4 designed to actuate and/or block these displacement means 3.

In other words, these actuating and locking means, or the actuator, respond to a control by the user to lower or raise the back 1 of the seat with respect to the bottom part 2 of this seat.

FIG. 2 shows an example of an actuator according to the invention in more detail.

This actuator comprises an electric motor 5 on which a transmission rod 6 is fitted and the function of which is to drive the movement of this rod 6. For example, this transmission may be a rotation.

Motor 5 is powered by a control device 9. A source voltage $V_s$ is transmitted to the system by diode CR1 through this control device 9.

The actuator also comprises a current release blocking device 7, to which voltage is applied through the control device 9. The function of this blocking device is to enable movement of rod 6 when it is powered by the control device 9, and on the other hand to prevent movement of the rod 6 when it is no longer powered.

For example, this current release blocking device 7 may be a current release brake or an electromagnet.

According to the invention, the motor 5 and the blocking device 7 are mounted in parallel and they are powered by the same control device 9.

Firstly, the control device 9 simultaneously powers the motor 5 and the blocking device 7 by a voltage of the same value (which may for example be 24 volts) to generate the movement. Secondly, the device enables simultaneous cut-off of the motor power supply 5 and the blocking device power supply 7 to block movement.

This type of actuator is almost completely irreversible, which means that the irreversibility of the actuator exceeds its dynamic capacity.

The operation that has just been described for motor 5 and the current release blocking device 7 is the same for unloaded movement and for movement with a driven load.

In the case of a driving load, the relation between the mechanical energy received and the electrical energy collected comes into play. For example for a DC motor, the voltage at its terminals is proportional to its rotation speed.

The control device 9 is controlled by the voltage $V_s$. It behaves so as to keep the motor voltage constant and at the same value as the voltage $V_s$ (when the motor acts as a generator under a driving load or when the motor has stopped).

In this case of a driving load, the control device 9 is effective whenever the actuator voltage $V_a$ is greater than the source voltage $V_s$. The transistor Q1 (for example a bipolar transistor) then becomes "conducting" so as to allow energy from the motor, which is now acting as a generator, to pass; transistor Q1 naturally becomes non-conducting again when the source voltage Vs becomes greater than the actuator voltage $V_a$, therefore when the motor is no longer acting as a generator.

Note that the motor stopping phase may be a special case of a driving load; the source voltage $V_s$ drops to about 0 volt, which means that transistor Q1 becomes conducting as soon as and for as long as $V_a$ is greater than $V_s$+0.6 volts in the case of the circuit shown in FIG. 2.

As shown in FIG. 2, the end of rod 6 is connected to a transmission system 8 that drives the mechanical displacement means 3 of back 1.

According to one embodiment of the invention, this transmission system 8 is a reduction gear with straight gear wheels which has the advantage of offering maximum efficiency and consequently reducing the electricity consumption, and the volume and weight of the actuation system compared with worm screw systems according to prior art.

This combination of "current release blocking device 7 and reduction gear with straight gear wheels 8" can give good irreversibility of the actuator while maintaining a good transmission efficiency; irreversibility and efficiency can be modulated independently of each other.

Furthermore, the invention has the advantage that no load power supply currents and fluctuations are much lower than with the worm screw system according to prior art, due to the elimination of high values of friction in the gear wheels which vary as a function of the temperature and risks of seizure after a prolonged stop.

Furthermore, in the system according to the invention the relation between consumed energy and the output torque is optimized and constant. In particular, in the case of a DC motor, the value of the current is an accurate image of the transmitted mechanical energy.

According to one embodiment of the invention, the system comprises a mechanical device 10 such as a lever, which can invert or mechanically reinforce the two states of the blocking device to compensate for a possible defect in the control device 9 or to obtain safety positions, for example in the case of passenger seats in an aircraft subject to the Federal Aviation Authority (FAA) regulations, and regulations of the corresponding authorities in member countries of the JAA (Joint Aircraft Authorities) which require that the seat be in the upright position during takeoff or landing of the aircraft.

What is claimed is:

1. System for modifying the position of the moving parts of a bed, chair or seat comprising:

mechanical means (3) for the displacement of a first part free to move with respect to a second fixed or moving part of the bed, chair or seat, actuation means (4) fixed on the chair, seat or bed to activate or lock the said displacement means of the first part, characterized in that the actuating and locking means comprise:

an electric motor (5) powered by a control device (9), a rod (6) driven by the motor, a current release blocking device (7), that prevents movement of the rod, mounted in parallel with the electric motor and connected to the control device (9), a transmission system (8) driving the first part displacement means at a determined speed.

2. System according to claim 1, characterized in that the current release blocking device is a brake that blocks rod (6) when it is no longer electrically powered and which enables movement on the rod when it is powered.

3. System according to claim 1, characterized in that the transmission system (8) is a reduction gear with straight gear wheels.

4. System according to claim 1, characterized in that the motor is a rotary motor driving rod (6) in a rotational movement.

5. System for modifying the position of the moving parts of a bed, chair or seat comprising:

mechanical means (3) for the displacement of a first part free to move with respect to a second fixed or moving part of the bed, chair or seat, actuation means (4) fixed on the chair, seat or bed to activate or lock the said displacement means of the first part, characterized in that the actuating and locking means comprise:

an electric motor (5) powered by a control device (9), a rod (6) driven by the motor, a current release blocking device (7), that prevents movement of the rod, mounted in parallel with the electric motor and connected to the control device (9), wherein the current release blocking device is a brake that blocks rod (6) when the brake is no longer electrically powered and which enables movement on the rod when the brake is powered, a transmission system (8) driving the first part displacement means at a determined speed.

* * * * *